US008415896B2

(12) United States Patent
Tseng et al.

(10) Patent No.: US 8,415,896 B2
(45) Date of Patent: Apr. 9, 2013

(54) CURRENT-TYPE DRIVER OF LIGHT EMITTING DEVICES

(75) Inventors: Yih-Long Tseng, Tainan County (TW); Shwang-Shi Bai, Tainan County (TW); Hon-Yuan Leo, Tainan County (TW); Ying-Jhong Tseng, Tainan County (TW)

(73) Assignee: Himax Display, Inc., Tainan (TW)

( * ) Notice: Subject to any disclaimer, the term of this patent is extended or adjusted under 35 U.S.C. 154(b) by 214 days.

(21) Appl. No.: 12/828,506

(22) Filed: Jul. 1, 2010

(65) Prior Publication Data

US 2011/0089859 A1 Apr. 21, 2011

Related U.S. Application Data

(60) Provisional application No. 61/252,170, filed on Oct. 16, 2009.

(51) Int. Cl.
*H05B 37/02* (2006.01)

(52) U.S. Cl.
USPC ..... 315/291; 315/307

(58) Field of Classification Search .... 315/169.1–169.4, 315/209 R, 291, 307, 308, 312; 345/48, 345/76–82, 204, 211–214
See application file for complete search history.

(56) References Cited

U.S. PATENT DOCUMENTS

| | | | | |
|---|---|---|---|---|
| 6,529,182 | B1 * | 3/2003 | Burton | 345/102 |
| 7,202,608 | B2 * | 4/2007 | Robinson et al. | 315/224 |
| 8,049,439 | B2 * | 11/2011 | Zhao et al. | 315/297 |
| 2009/0207109 | A1 * | 8/2009 | Wu et al. | 345/82 |

* cited by examiner

*Primary Examiner* — Jimmy Vu
(74) *Attorney, Agent, or Firm* — J.C. Patents

(57) ABSTRACT

A current-type driver of light emitting devices is provided. The current-type driver includes a power conversion circuit, a feedback module, and a control module. The power conversion circuit modulates and generates an output voltage according to a feedback signal so as to sequentially drive a plurality of light emitting devices. The feedback module generates the feedback signal for the power conversion circuit according to the output voltage and an adjusting signal during a first period, wherein none of the light emitting devices is driven during the first period. The control module outputs the adjusting signal to the feedback module during the first period so as to allow the power conversion circuit to adjust the output voltage to a pre-drive voltage corresponding to the light emitting device which is to be driven next among the light emitting devices.

13 Claims, 15 Drawing Sheets

CURRENT-TYPE DRIVER OF LIGHT EMITTING DEVICES

CROSS-REFERENCE TO RELATED APPLICATION

This application claims the priority benefit of U.S. provisional application Ser. No. 61/252,170, filed on Oct. 16, 2009. The entirety of the above-mentioned patent application is hereby incorporated by reference herein and made a part of specification.

BACKGROUND OF THE INVENTION

1. Field of the Invention

The present invention generally relates to a driver of light emitting devices, and more particularly, to a current-type driver of light emitting devices.

2. Description of Related Art

FIG. 1 is a diagram of a conventional voltage-type driver of light emitting devices. Referring to FIG. 1, the conventional voltage-type driver 100 includes a power conversion circuit 102, resistors R1 and R2, and an output capacitor Co. The voltage-type driver 100 divides an output voltage Vout through the resistors R1 and R2 to obtain a feedback signal Vf. The power conversion circuit 102 controls the duty cycle of a pulse width modulation (PWM) signal thereof according to the feedback signal Vf, so as to change the value of the output voltage Vout and provide a stable output voltage Vout to a load 104. In the conventional voltage-type driver 100, even though the output voltage Vout can be adjusted through the feedback signal Vf, the current (i.e., the driving current) output to the load 104 cannot be adjusted. Especially when the load 104 is light emitting diodes (LEDs) that emit light in different colors, the conventional voltage-type driver 100 cannot adjust the output currents supplied to the LEDs according to different characteristics of the LEDs that emit light in different colors. Thus, the conventional voltage-type driver 100 cannot meet the requirement of an actual application when it is applied to LEDs.

SUMMARY OF THE INVENTION

Accordingly, the present invention is directed to a current-type driver of light emitting devices, wherein power consumption produced for driving the light emitting devices or damage caused on transistor switches is avoided in the current-type driver.

According to an embodiment of the present invention, a current-type driver of a light emitting device is provided. The current-type driver includes a power conversion circuit, a feedback module, and a control module. The power conversion circuit modulates and generates an output voltage according to a feedback signal, so as to sequentially drive a plurality of light emitting devices. The feedback module is coupled to the power conversion circuit. The feedback module generates the feedback signal for the power conversion circuit according to the output voltage and an adjusting signal during a first period, wherein none of the light emitting devices is driven during the first period. The control module is coupled to the feedback module. The control module outputs the adjusting signal to the feedback module during the first period, wherein the control module controls the power conversion circuit to adjust the output voltage to a pre-drive voltage corresponding to the light emitting device which is to be driven next among the light emitting devices during the first period by using the adjusting signal.

As described above, in the present invention, the control module outputs the adjusting signal to the feedback module during the first period when none of the light emitting devices is driven, so that the power conversion circuit can adjust the output voltage to the pre-drive voltage corresponding to the light emitting device which is to be driven next. Thereby, power consumption or transistor switch damage can be avoided.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
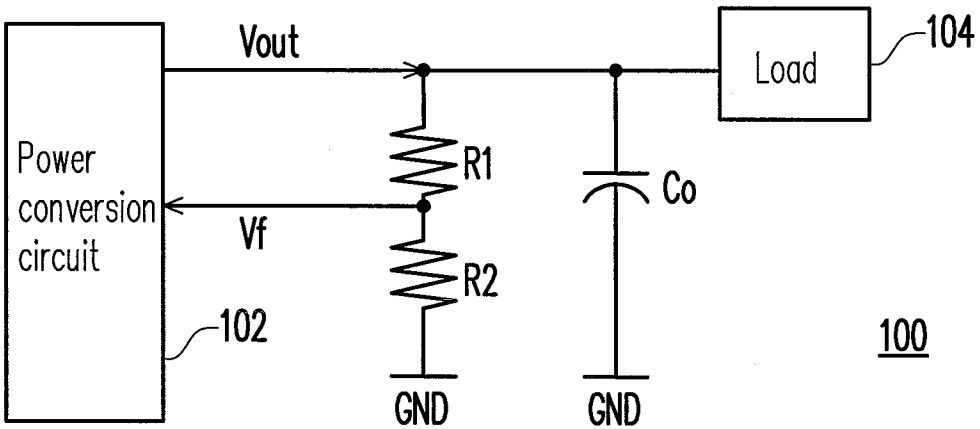
FIG. 1 (RELATED ART)
FIG. 1 is a diagram of a conventional voltage-type driver.

Reference will now be made in detail to the present preferred embodiments of the invention, examples of which are illustrated in the accompanying drawings. Wherever possible, the same reference numbers are used in the drawings and the description to refer to the same or like parts.

Figure 2:
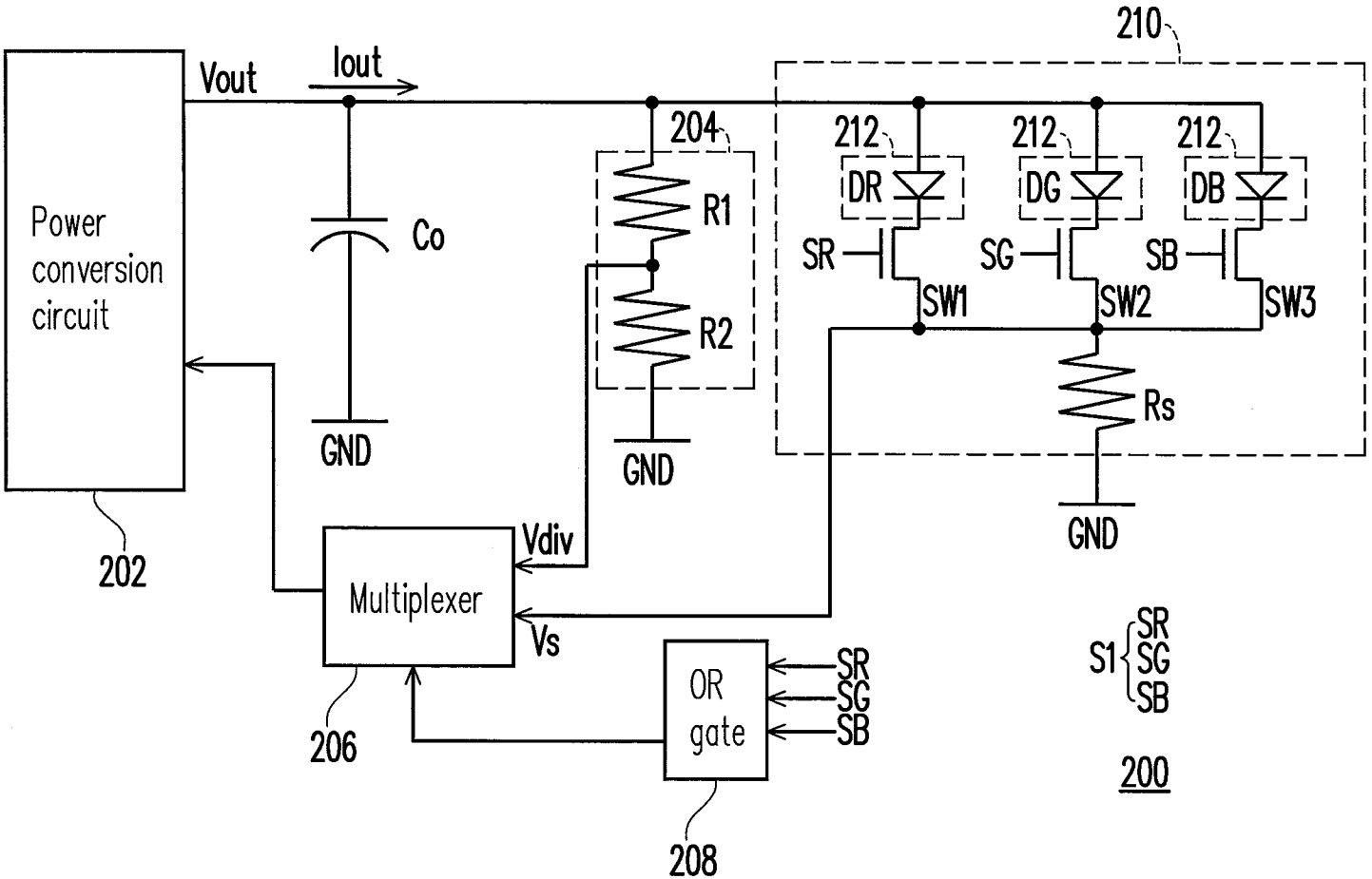
FIG. 2 is a block diagram of a current-type driver of light emitting devices according to an embodiment of the present invention.

FIG. 2 is a block diagram of a current-type driver of light emitting devices according to an embodiment of the present invention. Referring to FIG. 2, the current-type driver 200 includes a power conversion circuit 202, a voltage divider unit 204, a multiplexer 206, an OR gate 208, and an output capacitor Co. The power conversion circuit 202 is coupled to the voltage divider unit 204, the multiplexer 206, and a load 210. The output capacitor Co is coupled between the output terminal of the power conversion circuit 202 and the ground GND. The power conversion circuit 202 may be a DC/DC converter, and which sequentially drives a plurality of light emitting devices 212 that forms the load 210, wherein the light emitting devices 212 may be light emitting diodes (LEDs). In the present embodiment, the load 210 includes a sensing resistor Rs, transistor switches SW1-SW3, and a red LED DR, a green LED DG, and a blue LED DB which emit light in different colors, wherein the red LED DR, the green LED DG, and the blue LED DB respectively have different turn-on voltages.

The red LED DR, the green LED DG, and the blue LED DB are respectively connected to the transistor switches SW1, SW2, and SW3 in series, and the LEDs DR, DG, and DB and the transistor switches SW1-SW3 are connected between the output voltage Vout and the sensing resistor Rs in parallel. A second end of the sensing resistor Rs is coupled to the ground GND. In the present embodiment, the transistor switches SW1, SW2, and SW3 are n-type transistors (not limited thereto), and the on/off states thereof are controlled by an enabling signal S1. The enabling signal S1 contains three enabling signals SR, SG, and SB. The three enabling signals SR, SG, and SB are respectively coupled to the gates of the transistor switches SW1, SW2, and SW3 for controlling the on or off of the transistor switches SW1, SW2, and SW3. Two input terminals of the multiplexer 206 are respectively coupled to the voltage divider unit 204 and a first end of the sensing resistor Rs, a select terminal of the multiplexer 206 is coupled to the output terminal of the OR gate 208, and an output terminal of the multiplexer 206 is coupled to the power conversion circuit 202.

When a LED is driven, the transistor switch corresponding to the driven LED is turned on. For example, when the red LED DR is driven, the transistor switch SW1 corresponding to the red LED DR is turned on (herein the enabling signal SR is at a high voltage level). Thus, the output current Tout runs through the red LED DR, the transistor switch SW1, and the sensing resistor Rs so that the red LED DR can emit light. In addition, because the enabling signal SR at the high voltage level also makes the OR gate 208 to output a voltage at the logic level "1", a sensing voltage Vs produced by the output current Tout on the sensing resistor Rs can be sent to the power conversion circuit 202 through the multiplexer 206 as a feedback signal so that a control over the output current Tout is achieved.

Figure 3:
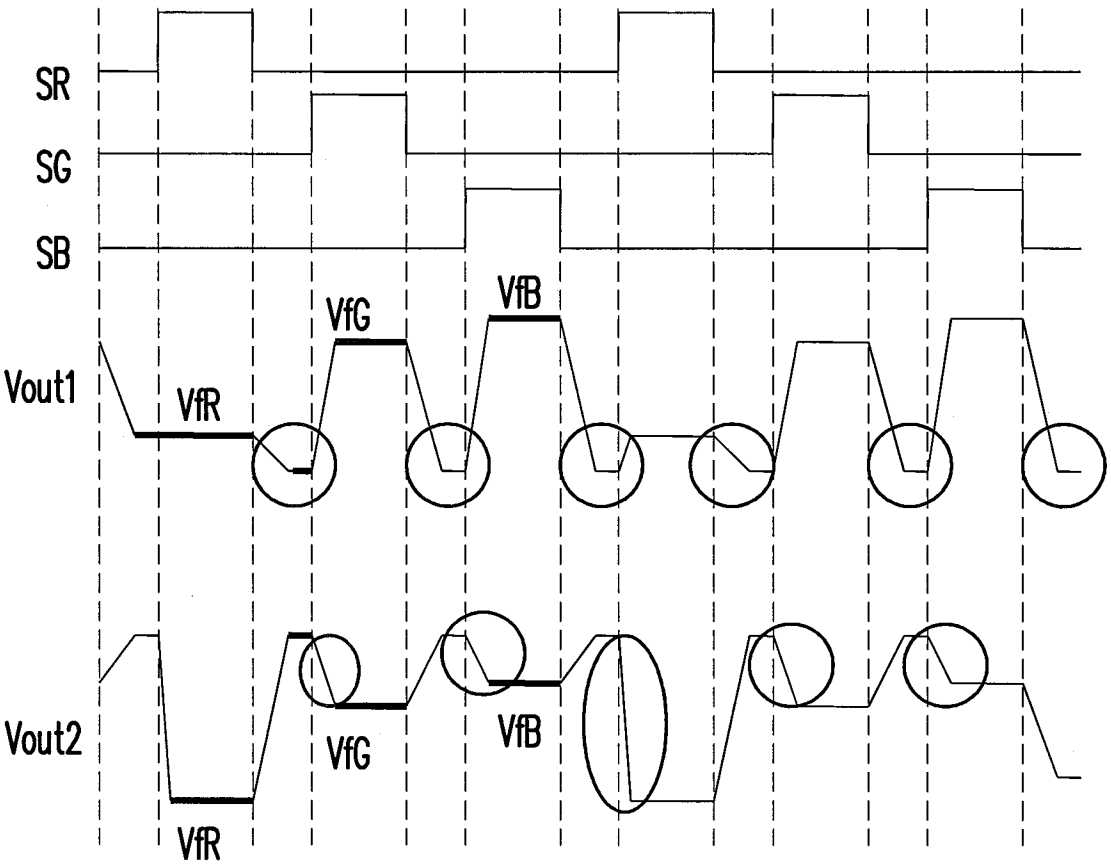
FIG. 3 illustrates the waveforms of enabling signals and an output voltage according to an embodiment of the present invention.

In an actual color sequential application, the red LED DR, the green LED DG, and the blue LED DB are respectively driven at different time points in a predetermined sequence. FIG. 3 illustrates the waveforms of the enabling signals SR, SG, and SB and the output voltage Vout. When the enabling signal SR is at the high voltage level, the enabling signals SG and SB are at the low voltage level, and only the transistor switch SW1 is turned on. Similarly, when the enabling signal SG is at the high voltage level, the enabling signals SR and SB are at the low voltage level, and only the transistor switch SW2 is turned on. When the enabling signal SB is at the high voltage level, the enabling signals SR and SG are at the low voltage level, and only the transistor switch SW3 is turned on.

During a period (referred to as the first period thereinafter) in which the driving of a current LED has ended while the driving of a next LED has not started yet, the enabling signals SR, SG, and SB are all at the low voltage level, and all the transistor switches SW1-SW3 are turned off. Since the enabling signals SR, SG, and SB are all at the low voltage level, the OR gate 208 outputs a voltage at the logic level "0". Accordingly, the multiplexer 206 outputs a voltage division Vdiv to the power conversion circuit 202 as the feedback signal. Thus, the output voltage Vout is stabilized to a specific level, and the output voltage Vout of the power conversion circuit 202 is prevented from constantly going up or even damaging the power conversion circuit 202 when the sensing voltage Vs becomes zero. In the present embodiment, the voltage divider unit 204 includes resistors R1 and R2. The resistors R1 and R2 are connected between the output voltage Vout and the ground GND in series, and the voltage division Vdiv is output from the common contact of the resistors R1 and R2.

It should be noted that because the red LED DR, the green LED DG, and the blue LED DB have different turn-on voltages, the red LED DR, the green LED DG, and the blue LED DB are corresponding to different output voltages Vout even if the three have the same current value. The voltage division Vdiv has to be set to an appropriate level to prevent any power consumption or transistor switch damage. For example, as shown in FIG. 3, it is assumed that the output voltages Vout required for turning on the red LED DR, the green LED DG, and the blue LED DB are respectively voltages VfR, VfG, and VfB, wherein the voltage level of the voltage VfG is between the voltage level of the voltage VfR and the voltage level of the voltage VfB. The output voltage Vout1 in FIG. 3 is the variation of the output voltage Vout when the voltage division Vdiv is set to be lower than the voltage VfR. The output voltage Vout2 in FIG. 3 is the variation of the output voltage Vout when the voltage division Vdiv is set to be higher than the voltage VfB.

When the voltage division Vdiv is set to be lower than the voltage VfR, during the period in which the driving of the red LED DR has ended while the driving of the green LED DG has not started (i.e., the enabling signals SR, SG, and SB are all at the low voltage level), the output capacitor Co is discharged so that the voltage on the output capacitor Co drops from the voltage VfR to the voltage division Vdiv. When subsequently the green LED DG is driven, the voltage on the output capacitor Co has to be charged to the voltage VfG again. Thus, power is consumed unnecessarily, and the time for turning on the transistor switch SW2 may be delayed.

Additionally, when the voltage division Vdiv is set to be higher than the voltage VfG and the voltage VfB, during the period in which the driving of the red LED DR has ended while the driving of the green LED DG has not started (i.e., the enabling signals SR, SG, and SB are all at the low voltage level), the output capacitor Co is charged so that the voltage on the output capacitor Co rises from the voltage VfR to the voltage division Vdiv. When subsequently the green LED DG is driven, the voltage on the output capacitor Co has to be discharged to the voltage VfG again. Thus, power is consumed unnecessarily. Moreover, when it is switched from the period in which the enabling signals SR, SG, and SB are all at the low voltage level to the period in which the red LED DR is driven, since the voltage on the output capacitor Co (i.e., the output voltage Vout) is much higher than the voltage VfR for turning on the red LED DR, a large surge current may be produced at the beginning when the red LED DR is turned on and accordingly the transistor switch SW1 or the red LED DR may be damaged. Thus, in the present embodiment, the voltage division Vdiv has to be designed at an appropriate level to prevent unnecessary power consumption or device damage.

Figure 4:
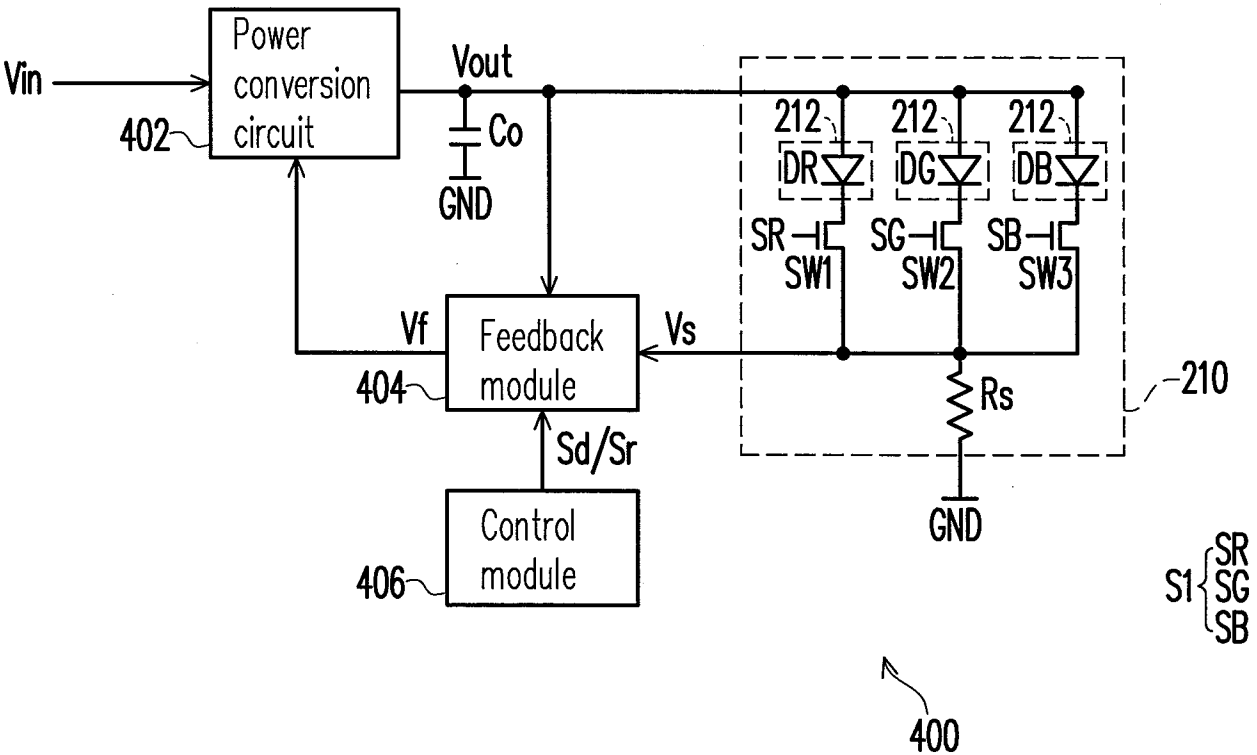
FIG. 4 is a block diagram of a current-type driver according to another embodiment of the present invention.

FIG. 4 is a block diagram of a current-type driver according to another embodiment of the present invention. Referring to FIG. 4, the current-type driver 400 includes a power conversion circuit 402, a feedback module 404, a control module 406, and an output capacitor Co. The input terminal of the power conversion circuit 402 is coupled to an input voltage Vin, the output terminal of the power conversion circuit 402 is coupled to the feedback module 404 and the load 210 as shown in FIG. 2, and the feedback module 404 is coupled to the power conversion circuit 402, the control module 406, and the load 210. The power conversion circuit 402 generates an output voltage Vout according to a feedback signal Vf and drives one of a plurality of light emitting devices (for example, a red LED DR, a green LED DG, and a blue LED DB) according to the output voltage Vout. The output capacitor Co is coupled between the output terminal of the power conversion circuit 402 and the ground GND.

During the period (referred to as a second period thereinafter) in which any one of the light emitting devices 212 is driven, the control module 406 outputs a corresponding driving signal Sd to the feedback module 404 according to the driven light emitting device 212, and the feedback module 404 generates the feedback signal Vf according to a sensing voltage Vs and the driving signal Sd. Accordingly, the power conversion circuit 402 adjusts the output voltage Vout to the driving voltage corresponding to the currently driven light emitting device 212 according to the feedback signal Vf. For example, when the red LED DR is driven, the driving signal Sd output by the control module 406 allows the power conversion circuit 402 to adjust the output voltage Vout to the voltage VfR.

During the first period (i.e., the enabling signals SR, SG, and SB are all at the low voltage level), all the transistor switches SW1-SW3 are turned off, namely, none of the light emitting devices 212 is driven. Herein the control module 406 outputs an adjusting signal Sr to the feedback module 404, and the feedback module 404 generates the feedback signal Vf according to the output voltage Vout and the adjusting signal Sr, so that the power conversion circuit 402 adjusts the output voltage Vout to a pre-drive voltage corresponding to the light emitting device 212 which is to be driven next according to the feedback signal Vf. For example, referring to the waveform of the output voltage illustrated in FIG. 3, the output voltage Vout is first adjusted to a pre-drive voltage corresponding to the green LED DG (for example, a voltage level close to the voltage VfG) during the period in which the driving of the red LED DR has ended while the driving of the green LED DG has not started, so that unnecessary power consumption and damage on the transistor switches avoided.

Figure 5:
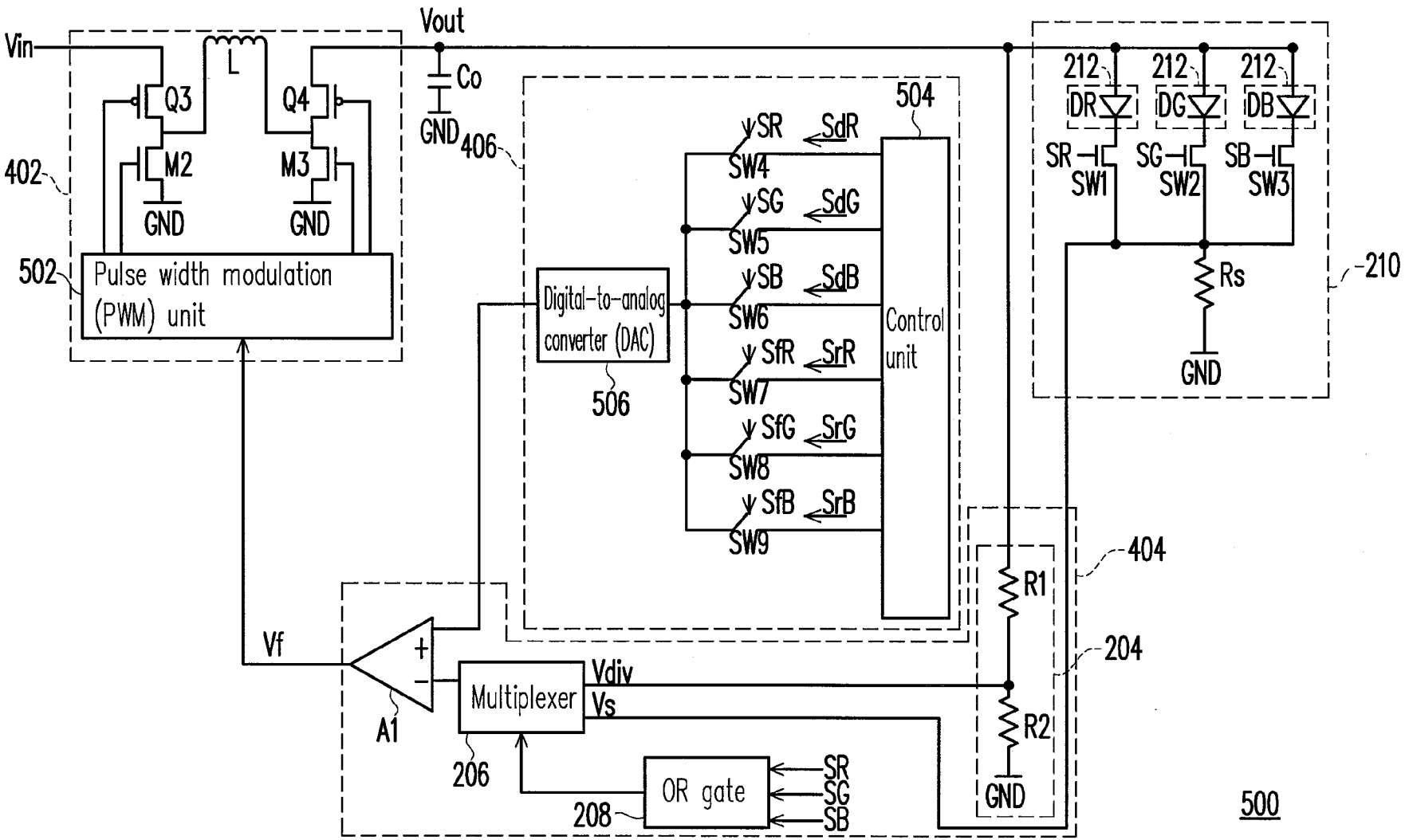
FIG. 5 is a circuit diagram of a current-type driver according to another embodiment of the present invention.

To be specific, the current-type driver 400 in FIG. 4 can be implemented according to the circuit of the current-type driver 500 in FIG. 5. FIG. 5 is a circuit diagram of a current-type driver according to another embodiment of the present invention. Referring to FIG. 5, in the present embodiment, the power conversion circuit 402 includes p-type transistors Q3 and Q4, n-type transistors M2 and M3, an inductor L, and a pulse width modulation (PWM) unit 502. The n-type transistor M2 and the p-type transistor Q3 are connected between the input voltage Vin and the ground GND in series. The n-type transistor M3 and the p-type transistor Q4 are connected between the output voltage Vout and the ground GND in series. The inductor L is coupled between the common contact of the p-type transistor Q3 and the n-type transistor M2 and the common contact of the p-type transistor Q4 and the n-type transistor M3. In addition, the PWM unit 502 is coupled to the gates of the p-type transistors Q3 and Q4, the gates of the n-type transistors M2 and M3, and the feedback module 404.

The feedback module 404 includes the voltage divider unit 204, the multiplexer 206, and the OR gate 208 illustrated in FIG. 2. Besides, the feedback module 404 further includes a comparison unit A1. The couplings between the voltage divider unit 204, the multiplexer 206, and the OR gate 208 are the same as those illustrated in FIG. 2, and a first input terminal (e.g. non-inverting input terminal) and a second input terminal (e.g. inverting input terminal) of the comparison unit A1 are respectively coupled to the control module 406 and the multiplexer 206. The comparison unit A1 may be a voltage comparator or an error amplifier.

Additionally, the control module 406 includes a control unit 504, switches SW4-SW9, and a digital-to-analog converter (DAC) 506. The control unit 504 generates the driving signal Sd (including driving signals SdR, SdG, and SdB) and the adjusting signal Sr (including adjusting signals SrR, SrG, and SrB that are respectively corresponding to the red LED DR, the green LED DG, and the blue LED DB). The switches SW4-SW6 are respectively coupled to the corresponding output terminal of the control unit 504 for receiving the driving signals SdR, SdG, and SdB, and the switches SW7-SW9 are respectively coupled to the corresponding output terminal of the control unit 504 for receiving the adjusting signals SrR, SrG, and SrB. The switches SW4-SW6 are respectively controlled by the enabling signals SR, SG, and SB, and the switches SW7-SW9 are respectively controlled by flag signals SfR, SfG, and SfB. In addition, another terminals of the switches SW4-SW9 are coupled to the input terminal of the DAC 506. The output terminal of the DAC 506 is coupled to the non-inverting input terminal of the comparison unit A1.

Figure 6:
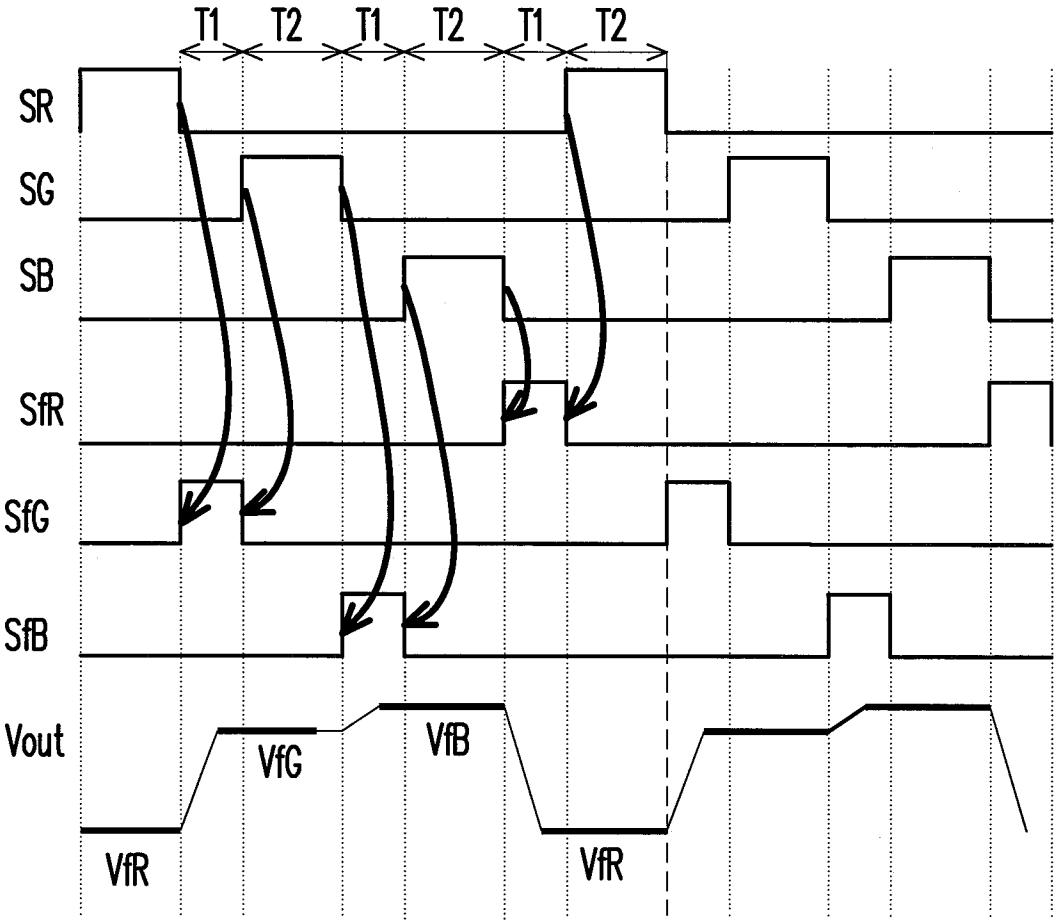
FIG. 6 illustrates the waveforms of enabling signals, flag signals, and an output voltage according to the embodiment illustrated in FIG. 5.

FIG. 6 illustrates the waveforms of the enabling signals SR, SG, and SB, the flag signals SfR, SfG, and SfB, and the output voltage Vout according to the embodiment illustrated in FIG. 5. Below, the operation of the current-type driver 500 will be described with reference to FIG. 5 and FIG. 6. When the red LED DR, the green LED DG, or the blue LED DB is driven during the second period T2, the corresponding enabling signal turns on the corresponding transistor switch and the corresponding switch. For example, when the red LED DR is driven, the enabling signal SR turns on the transistor switch SW1 and the switch SW4 so that the sensing voltage Vs on the sensing resistor Rs can be transferred to the inverting input terminal of the comparison unit A1 through the multiplexer 206. Meanwhile, the driving signal SdR output by the control unit 504 is also transferred to the DAC 506 through the switch SW4. The driving signal SdR is converted into an analog signal by the DAC 506 and is then sent to the non-inverting input terminal of the comparison unit A1 as the driving signal Sd. The comparison unit A1 compares the analog driving signal SdR with the sensing voltage Vs and outputs the comparison result (for example, the difference between the voltage of the driving signal SdR and the sensing voltage Vs) to the PWM unit 502 as the feedback signal Vf. The PWM unit 502 controls the on/off states of the p-type transistor Q3, the p-type transistor Q4, the n-type transistor M2, and the n-type transistor M3 according to the feedback signal Vf to adjust the output voltage Vout. When the feedback is stable, the sensing voltage Vs is about equal to the voltage level of the analog driving signal SdR converted by the DAC 506. The green LED DG or the blue LED DB may be driven in the same manner therefore will not be described herein.

In addition, during the first period T1, the enabling signals SR, SG, and SB are all at the low voltage level (i.e., all the transistor switches SW1-SW3 are turned off, and none of the LEDs DR, DG, and DB is driven), the switch corresponding to the flag signal of the LED to be driven next is turned on. For example, as shown in FIG. 6, the flag signal SfG is enabled between the negative edge of the enabling signal SR and the positive edge of the enabling signal SG. Thus, the switch SW8 corresponding to the flag signal SfG of the green LED DG which is to be driven next is turned on, so that the adjusting signal SrG is transferred to the DAC 506 through the switch SW8. The adjusting signal SrG is converted into an analog signal by the DAC 506 and is then sent to the non-inverting input terminal of the comparison unit A1 as the adjusting signal Sr. During the same first period T1, the voltage division Vdiv produced by the resistors R1 and R2 is sent to the inverting input terminal of the comparison unit A1 through the multiplexer 206. The comparison unit A1 compares the adjusting signal SrG with the voltage division Vdiv and outputs the comparison result to the PWM unit 502 as the feedback signal Vf.

The PWM unit 502 controls the on/off states of the p-type transistor Q3, the p-type transistor Q4, the n-type transistor M2, and the n-type transistor M3 according to the feedback signal Vf to adjust the output voltage Vout of the power conversion circuit 402 to the voltage VfG for driving the green LED DG. When the feedback is stable, the voltage division Vdiv is about equal to the voltage level of the analog adjusting signal SrG converted by the DAC 506, and the output voltage Vout satisfies Vout=Vdiv×(R1+R2)/R2. Thus, the pre-drive voltage corresponding to the next light emitting device (i.e., the green LED DG) can be obtained by setting an appropriate adjusting signal SrG (for example, for adjusting the output voltage Vout to the voltage VfG). Similarly, the output voltage Vout may be adjusted into the pre-drive voltage corresponding to the next LED before the driving of the next LED starts through the same method therefore will not be described herein. As described above, unnecessary power consumption of transistor switch damaged can be avoided by adjusting the output voltage Vout into the pre-drive voltage corresponding to the LED to be driven next. Moreover, time delay between the positive edge of an enabling signal and the actual turn-on time of the corresponding transistor switch is reduced so that the turn-on time of the light emitting device won't be affected.

Figure 7:
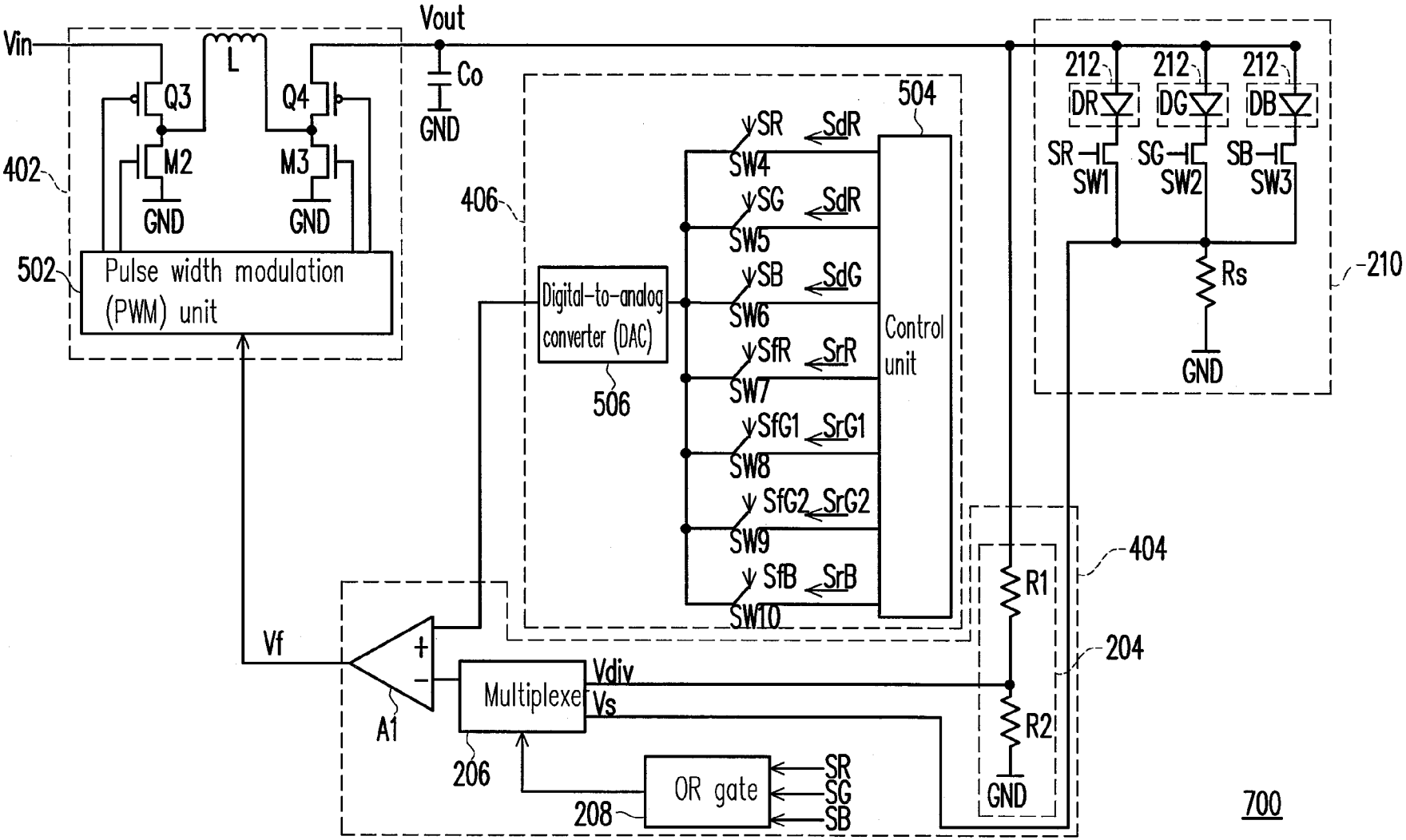
FIG. 7 is a circuit diagram of a current-type driver according to another embodiment of the present invention.
Figure 8:
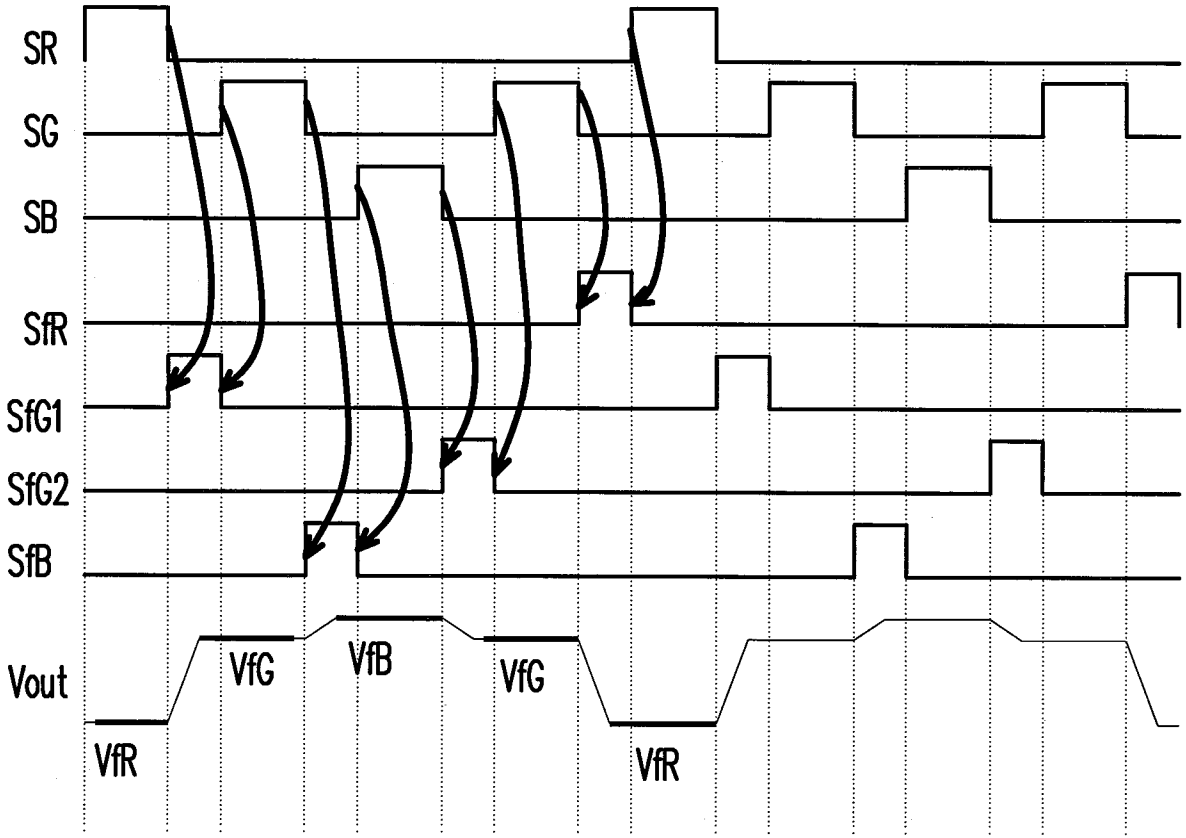
FIG. 8 illustrates the waveforms of enabling signals, flag signals, and an output voltage according to the embodiment illustrated in FIG. 7.

It should be noted that even though the operation of the current-type driver is described with reference to a R, G, and B color sequence in foregoing embodiment, the present invention is not limited thereto. A user can apply the present embodiment to different color sequences according to the actual requirement. The current-type driver 700 illustrated in FIG. 7 drives LEDs according to a R, G, B, and G color sequence. The current-type driver 700 has adjusting signals SrR, SrG1, SrG2, and SrB and corresponding flag signals SfR, SfG1, SfG2, and SfB. The operation principle of the current-type driver 700 is similar to that of the current-type driver 500 illustrated in FIG. 5, and the waveforms of the enabling signals, flag signals, and output voltage in the current-type driver 700 are as shown in FIG. 8. The operation pattern of the current-type driver 700 and the waveform changes of its enabling signals, flag signals, and output voltage can be understood by those having ordinary knowledge in the art according to the descriptions of foregoing embodiments therefore will not be described herein.

Figure 9:
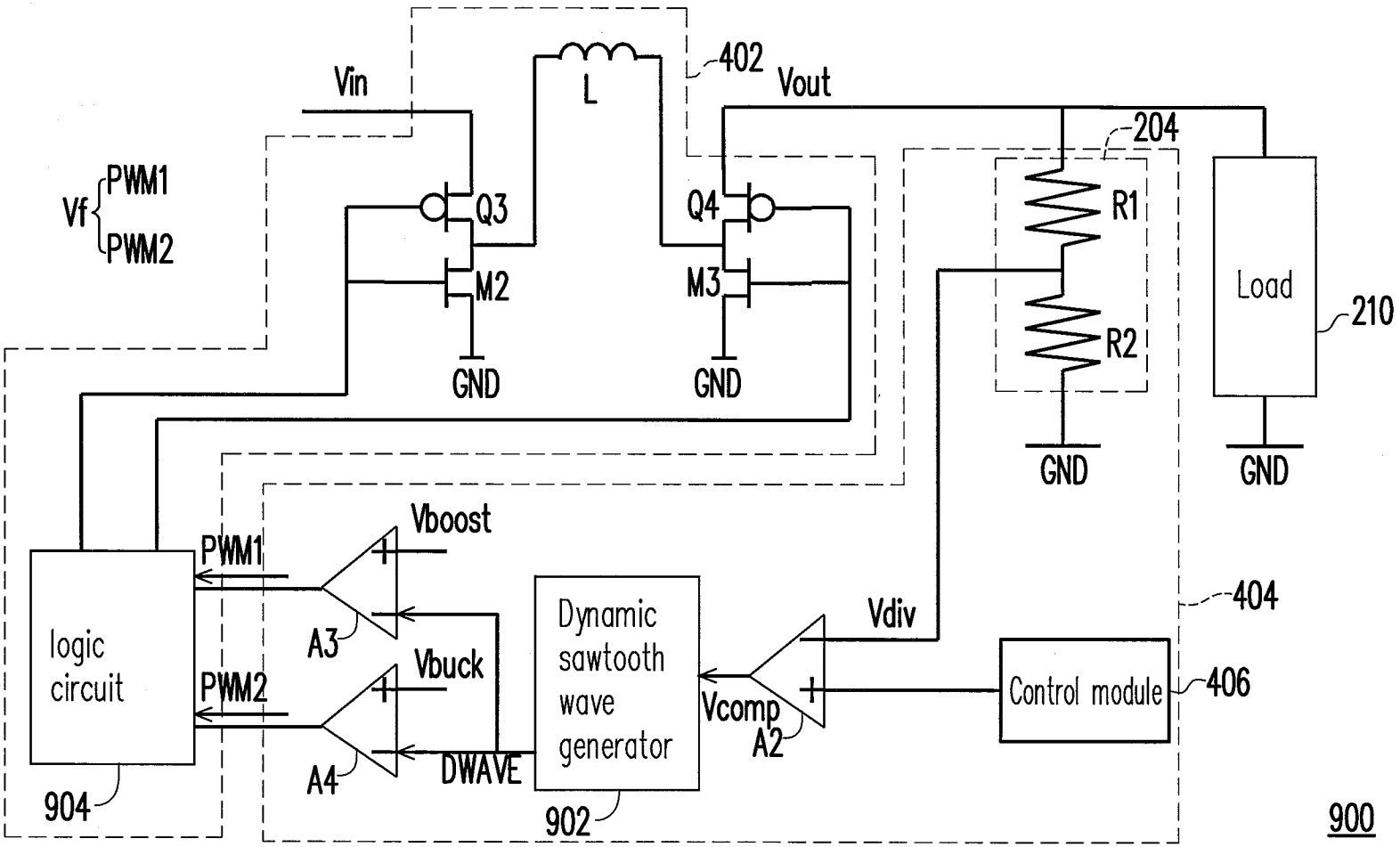
FIG. 9 is a diagram of a current-type driver according to another embodiment of the present invention.

FIG. 9 is a diagram of a current-type driver according to another embodiment of the present invention. Referring to FIG. 9, the difference between the current-type driver 900 in the present embodiment and the current-type driver 500 in FIG. 5 is that the feedback module 404 further includes comparison units A2-A4 and a dynamic sawtooth wave generator 902 besides the voltage divider unit 204. The comparison unit A2 may be an error amplifier, and the comparison units A3 and A4 may be voltage comparators. A first input terminal (e.g. non-inverting input terminal) and a second input terminal (e.g. inverting input terminal) of the comparison unit A2 are respectively coupled to the voltage divider unit 204 and the control module 406. The dynamic sawtooth wave generator 902 is coupled to the output terminal of the comparison unit A2. A first input terminal (e.g. non-inverting input) terminal and a second input terminal (e.g. inverting input terminal) of the comparison unit A3 are respectively coupled to a boost voltage Vboost and the dynamic sawtooth wave generator 902, and the output terminal of the comparison unit A3 is coupled to a logic circuit 904 in the power conversion circuit 402. A first input terminal (e.g. non-inverting input terminal) and a second input terminal (e.g. inverting input terminal) of the comparison unit A4 are respectively coupled to the buck voltage Vbuck and the dynamic sawtooth wave generator 902, and the output terminal of the comparison unit A4 is coupled to the logic circuit 904 in the power conversion circuit 402.

In the present embodiment, the current-type driver 900 adjusts the DC voltage level in the sawtooth wave signal DWAVE according to the voltage division Vdiv and serves the comparison result (a PWM signal PWM1 and a PWM signal PWM2) between the boost voltage Vboost, the buck voltage Vbuck, and the sawtooth wave signal DWAVE as the feedback signal Vf, and the logic circuit 904 adjusts the output voltage Vout by generating a corresponding driving signal according to the feedback signal Vf.

When the driving signal or adjusting signal output by the control module 406 has a higher voltage level, a higher comparison voltage Vcomp is output by the comparison unit A2, and accordingly the sawtooth wave signal DWAVE output by the dynamic sawtooth wave generator 902 shifts entirely towards higher voltage levels (i.e., the DC voltage level in the sawtooth wave signal DWAVE is increased). Contrarily, when the driving signal or adjusting signal output by the control module 406 has a lower voltage level, a lower comparison voltage Vcomp is output by the comparison unit A2, and accordingly the sawtooth wave signal DWAVE output by the dynamic sawtooth wave generator 902 shifts entirely toward lower voltage level (i.e., the DC voltage level in the sawtooth wave signal DWAVE is reduced.).

Figure 10:
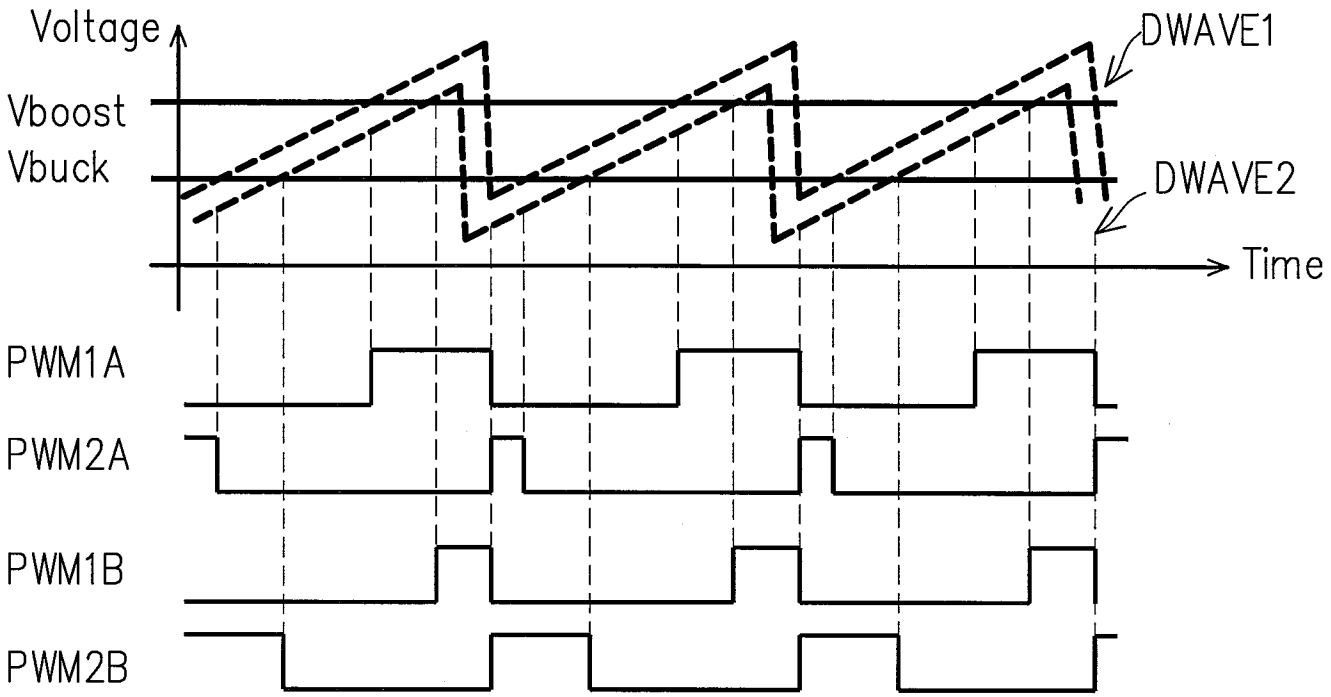
FIG. 10 illustrates the waveforms of sawtooth wave signals and pulse width modulation (PWM) signals according to an embodiment of the present invention.

FIG. 10 illustrates the waveforms of sawtooth wave signals and PWM signals, wherein the sawtooth wave signal DWAVE1 is output by the dynamic sawtooth wave generator 902 when the voltage on the non-inverting input terminal of the comparison unit A2 is higher, and the sawtooth wave signal DWAVE2 is output by the dynamic sawtooth wave generator 902 when the voltage on the non-inverting input terminal of the comparison unit A2 is lower. The PWM signals PWM1A and PWM2A in FIG. 10 are the PWM signals PWM1 and PWM2 respectively output from the output terminals of the comparison units A3 and A4 after the sawtooth wave signal DWAVE1 is respectively compared with the boost voltage Vboost and the buck voltage Vbuck. Similarly, the PWM signals PWM1B and PWM2B in FIG. 10 are the PWM signals PWM1 and PWM2 respectively output from the output terminals of the comparison units A3 and A4 after the sawtooth wave signal DWAVE2 is respectively compared with the boost voltage Vboost and the buck voltage Vbuck. Thereafter, the PWM signals PWM1A and PWM2A (or the PWM signals PWM1B and PWM2B) are sent to the logic circuit 904 as the feedback signal Vf so that the logic circuit 904 can adjust the output voltage Vout according to the PWM signals PWM1A and PWM2A (or the PWM signals PWM1B and PWM2B).

The higher DC voltage level the sawtooth wave signal DWAVE has, the higher output voltage Vout of the power conversion circuit 402 is, and the lower DC voltage level the sawtooth wave signal DWAVE has, the lower the output voltage Vout of the power conversion circuit 402 is. As described above, the output voltage Vout of the power conversion circuit 402 can be controlled by simply setting the voltage on the non-inverting input terminal of the comparison unit A2 to an appropriate level. Thus, in the present embodiment, the waveform control over the output voltage Vout as illustrated in FIG. 6 can be achieved by using the driving signal Sd or the adjusting signal Sr output by the control module 406. The detailed operation principle has been described in foregoing embodiments therefore will not be described herein.

Figure 11:
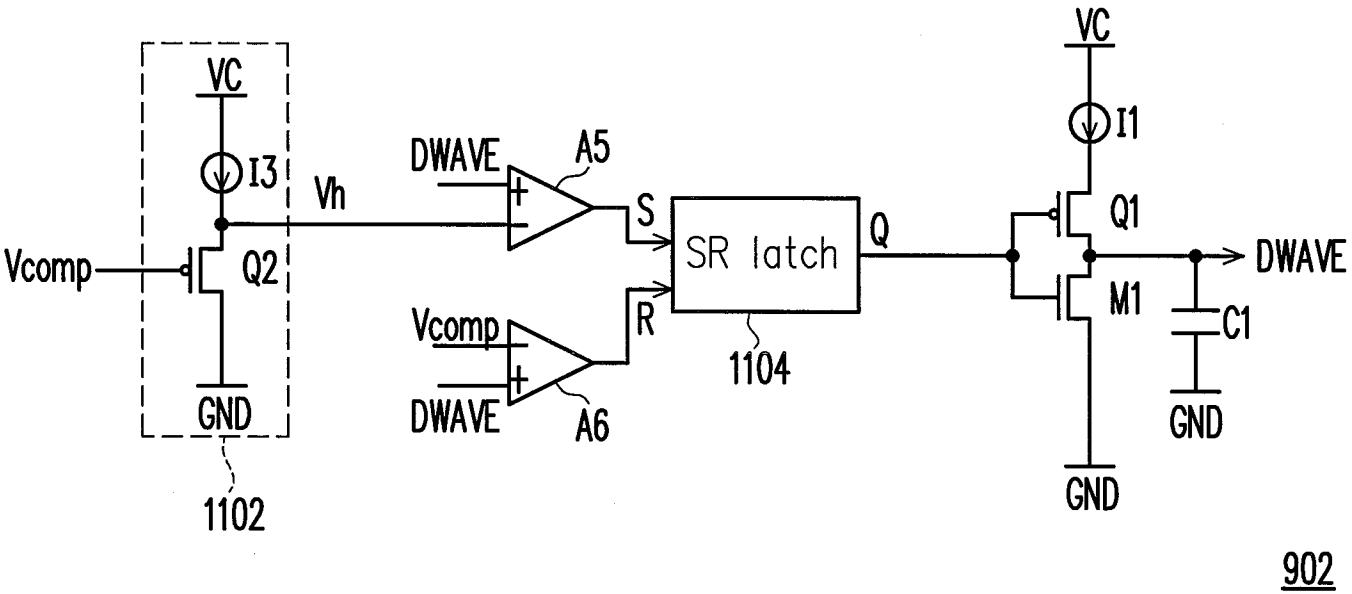
FIG. 11 is a circuit diagram of a dynamic sawtooth wave generator according to an embodiment of the present invention.

To be specific, the dynamic sawtooth wave generator 902 may be implemented as the circuit illustrated in FIG. 11. FIG. 11 is a circuit diagram of the dynamic sawtooth wave generator 902 according to an embodiment of the present invention. Referring to FIG. 11, the dynamic sawtooth wave generator 902 includes an upper limit voltage generator 1102, a comparison unit A5, a comparison unit A6, a SR latch 1104, a current source I1, a p-type transistor Q1, an n-type transistor M1, and a capacitor C1. The upper limit voltage generator 1102 is coupled to the comparison voltage Vcomp, and which generates an upper limit voltage Vh according to the comparison voltage Vcomp. The upper limit voltage Vh is a crest value (an upper limit) of the sawtooth wave signal DWAVE generated by the dynamic sawtooth wave generator 902, and the comparison voltage Vcomp is a trough value (a lower limit) of the sawtooth wave signal DWAVE.

In the present embodiment, the upper limit voltage generator 1102 includes a current source I3 and a p-type transistor Q2. The current source I3 is coupled between an operating voltage VC and the output terminal of the upper limit voltage generator 1102, the p-type transistor Q2 is coupled between the output terminal of the upper limit voltage generator 1102 and the ground GND, and the gate of the p-type transistor Q2 is coupled to the comparison voltage Vcomp. In other embodiments, the upper limit voltage generator 1102 may be any level shift circuit.

The comparison units A5 and A6 may be voltage comparators. A first input terminal (e.g. non-inverting input terminal) and a second input terminal (e.g. inverting input terminal) of the comparison unit A5 are respectively coupled to the sawtooth wave signal DWAVE and the upper limit voltage Vh, and the output terminal of the comparison unit A5 is coupled to the SET terminal S of the SR latch 1104. A first input terminal (e.g. inverting input terminal) and a second input terminal (e.g. non-inverting input terminal) of the comparison unit A6 are respectively coupled to the comparison voltage Vcomp and the sawtooth wave signal DWAVE, and the output terminal of the comparison unit A6 is coupled to the RESET terminal R of the SR latch 1104. The output terminal Q of the SR latch 1104 is coupled to the gates of the p-type transistor Q1 and the n-type transistor M1. The current source I1 and the p-type transistor Q1 are connected between the operating voltage VC and the output terminal of the dynamic sawtooth wave generator 902. The n-type transistor M1 is connected between the output terminal of the dynamic sawtooth wave generator 902 and the ground GND. The capacitor C1 is coupled between the output terminal of the dynamic sawtooth wave generator 902 and the ground GND.

The upper limit voltage generator 1102 pulls up the comparison voltage Vcomp output by the comparison unit A2 for a fixed voltage ΔV and then outputs the upper limit voltage Vh, wherein Vh=Vcomp+ΔV. In the present embodiment, the fixed voltage ΔV is equal to the threshold voltage of the p-type transistor Q2. The comparison unit A5 outputs the comparison result between the sawtooth wave signal DWAVE and the upper limit voltage Vh to the SET terminal S of the SR latch 1104, and the comparison unit A6 outputs the comparison result between the sawtooth wave signal DWAVE and the comparison voltage Vcomp to the RESET terminal R of the SR latch 1104.

Figure 12:
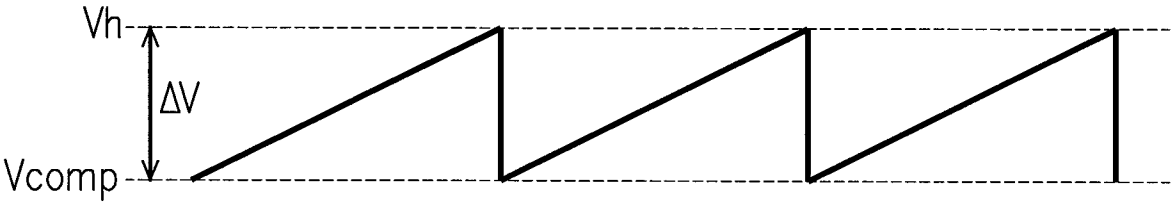
FIG. 12 illustrates the waveform of a sawtooth wave signal according to the embodiment illustrated in FIG. 11.

When the voltage level of the sawtooth wave signal DWAVE is equal to or lower than the comparison voltage Vcomp, the output terminal of the SR latch 1104 is at the low voltage level so that the p-type transistor Q1 is turned on while the n-type transistor M1 is turned off. Herein the current source I1 charges the capacitor C1 through the p-type transistor Q1, and accordingly the voltage level of the sawtooth wave signal DWAVE rises at a predetermined rate. When the voltage level of the sawtooth wave signal DWAVE is equal to or higher than the upper limit voltage Vh, the output terminal of the SR latch 1104 is at the high voltage level so that the p-type transistor Q1 is turned off while the n-type transistor M1 is turned on. Herein the capacitor C1 discharges the ground GND through the n-type transistor M1, and accordingly the voltage level of the sawtooth wave signal DWAVE drops quickly. The sawtooth wave signal DWAVE having the waveform as illustrated in FIG. 12 can be output from the output terminal of the dynamic sawtooth wave generator 902 by repeatedly switching the on/off states of the p-type transistor Q1 and the n-type transistor M1 as described above.

Figure 13:
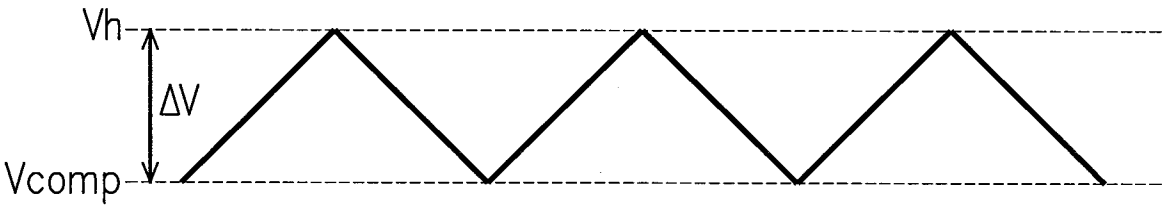
FIG. 13 illustrates the waveform of a sawtooth wave signal according to another embodiment of the present invention.
Figure 14:
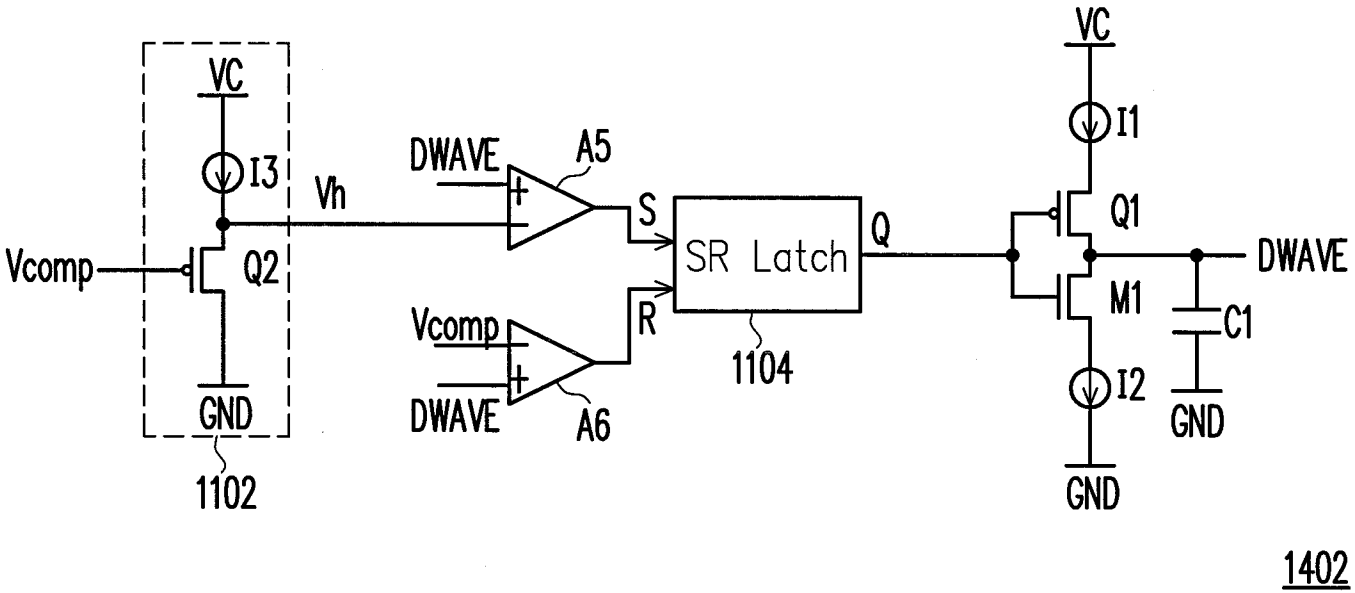
FIG. 14 is a circuit diagram of a dynamic sawtooth wave generator which generates the sawtooth wave signal according to the embodiment illustrated in FIG. 13.

In some embodiments, the sawtooth wave signal DWAVE output by the dynamic sawtooth wave generator 902 may also have the triangular waveform as illustrated in FIG. 13, and the dynamic sawtooth wave generator 1402 illustrated in FIG. 14 may be adopted for generating the triangular waveform illustrated in FIG. 13. One using the present embodiment can replace the dynamic sawtooth wave generator 902 in FIG. 9 with the dynamic sawtooth wave generator 1402 according to the actual design requirement. The related operation principle of the dynamic sawtooth wave generator 1402 can be referred to the related description of the embodiment illustrated in FIG. 11 therefore will not be described herein. The difference between the dynamic sawtooth wave generator 1402 and the dynamic sawtooth wave generator 902 is that the dynamic sawtooth wave generator 1402 further includes a current source I2 coupled between the n-type transistor M1 and the ground GND. When the p-type transistor Q1 is turned off while the n-type transistor M1 is turned on, the capacitor C1 discharges the ground GND with a fixed current through the n-type transistor M1 and the current source I2. Accordingly, the voltage on the capacitor C1 dose not drop to the ground voltage instantly, and a triangular sawtooth wave signal DWAVE is produced on the output terminal of the dynamic sawtooth wave generator 1402.

Figure 15:
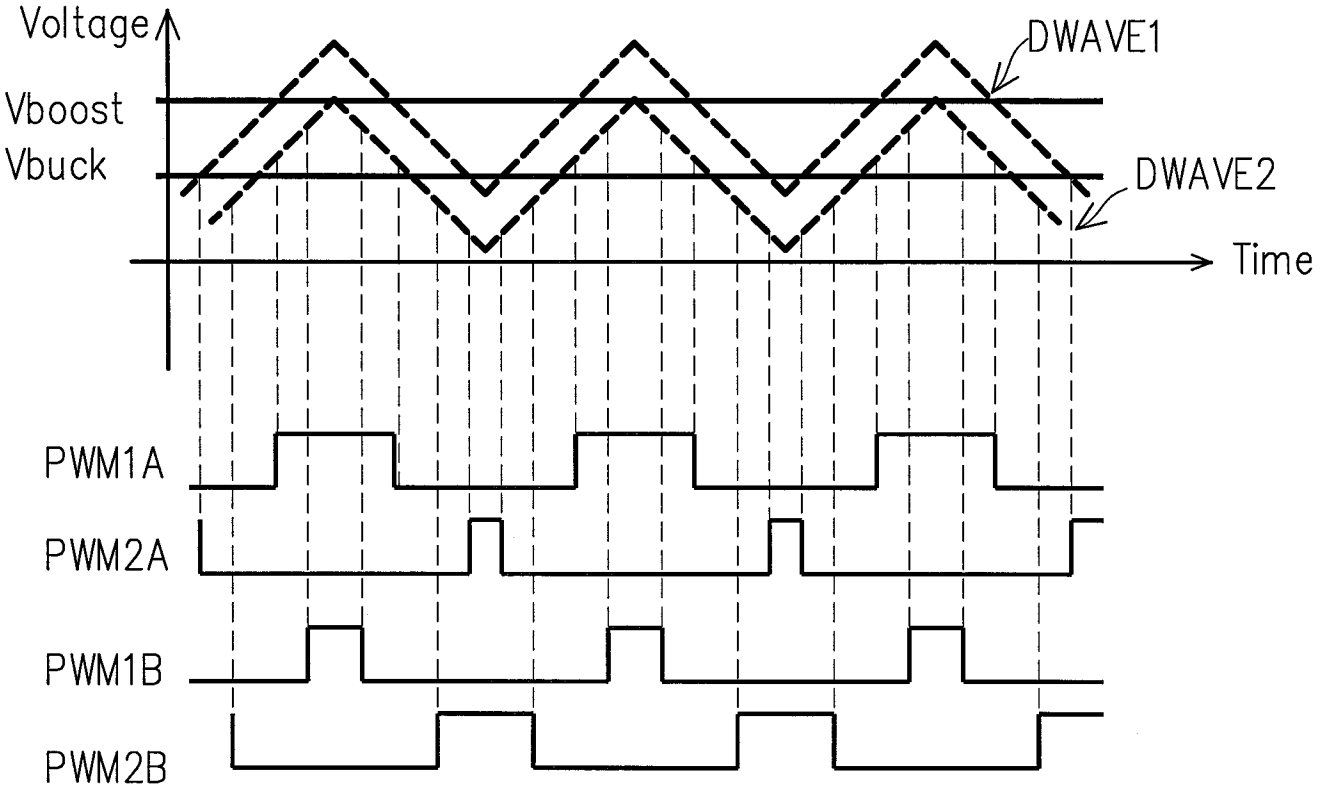
FIG. 15 illustrates the waveforms of sawtooth wave signals and PWM signals according to another embodiment of the present invention.

The voltage level of the triangular sawtooth wave signal DWAVE may also be shifted (i.e., the DC voltage level in the triangular wave is adjusted) under the control of the control module 406, as in the embodiment illustrated in FIG. 9. The DC voltage level in the triangular sawtooth wave signal DWAVE changes along with the variation of the feedback voltage (the voltage division Vdiv), for example, from DWAVE1 to DWAVE2 as shown in FIG. 15. When the sawtooth wave signal DWAVE output by the dynamic sawtooth wave generator 1402 is the DWAVE1 as shown in FIG. 15, the PWM signals PWM1 and PWM2 output by the comparison units A3 and A4 in FIG. 9 then have the waveforms PWM1A and PWM2A as illustrated in FIG. 15. When the sawtooth wave signal DWAVE output by the dynamic sawtooth wave generator 1402 is the DWAVE2 as shown in FIG. 15, the PWM signals PWM1 and PWM2 output by the comparison units A3 and A4 in FIG. 9 then have the waveforms PWM1B and PWM2B as illustrated in FIG. 15. After the dynamic sawtooth wave generator 902 in FIG. 9 is replaced with the dynamic sawtooth wave generator 1402, the related operation principle of the current-type driver 900 can be referred to related descriptions of the embodiments illustrated in FIG. 9 and FIG. 11 therefore will not be described herein.

In summary, in the present invention, a control module outputs an adjusting signal to a feedback module during a first period in which no light emitting device is driven, the feedback module generates a feedback signal for a power conversion circuit according to the adjusting signal, and the power conversion circuit adjusts the output voltage to a pre-drive voltage corresponding to the light emitting device that is next to be driven. Thereby, unnecessary power consumption or transistor switch damage is avoided, and time delay between the positive edge of the enabling signal and the actual turn-on time of the corresponding transistor switch is reduced so that the turn-on time of the light emitting device will not be affected.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A current-type driver of light emitting devices, comprising:

a power conversion circuit, for modulating and generating an output voltage according to a feedback signal, so as to sequentially drive a plurality of light emitting devices;

a feedback module, coupled to the power conversion circuit, for generating the feedback signal for the power conversion circuit according to the output voltage and an adjusting signal during a first period, wherein none of the light emitting devices is driven during the first period; and a control module, coupled to the feedback module, for outputting the adjusting signal to the feedback module during the first period, wherein the control module controls the power conversion circuit to adjust the output voltage to a pre-drive voltage corresponding to a light emitting device which is to be driven next among the light emitting devices during the first period by using the adjusting signal, wherein the control module further outputs a driving signal to the feedback module according to the light emitting device that is driven, so that the feedback module generates the feedback signal for the power conversion circuit according to currents of the light emitting devices and the driving signal during a second period, wherein one of the light emitting devices is driven during the second period, and the power conversion circuit adjusts the output voltage to a driving voltage corresponding to the driven light emitting device according to the feedback signal, and the light emitting devices are respectively connected to transistor switches in series, and the light emitting devices and the transistor switches are connected between the output voltage and a sensing resistor in parallel, a second end of the sensing resistor is connected to a ground, and an on/off state of each of the transistor switches is controlled by an enabling signal.

2. The current-type driver according to claim 1, wherein the feedback module comprises:

a voltage divider unit, coupled between the output voltage and the ground, for dividing the output voltage to output a voltage division;

an OR gate, having input terminals respectively coupled to one of the enabling signals;

a multiplexer, coupled to the voltage divider unit and a first end of the sensing resistor, for selectively outputting the voltage division or a sensing voltage on the sensing resistor according to an output of the OR gate; and a first comparison unit, having a first input terminal and a second input terminal respectively coupled to the control module and the multiplexer, for comparing the voltage division or the sensing voltage output by the multiplexer with the output of the control module and outputting the feedback signal to the power conversion circuit according to a comparison result.

3. The current-type driver according to claim 2, wherein the voltage divider unit comprises:

a first resistor; and a second resistor, wherein the second resistor and the first resistor are connected between the output voltage and the ground in series.

4. The current-type driver according to claim 1, wherein the feedback module comprises:

a voltage divider unit, coupled between the output voltage and the ground, for dividing the output voltage to output a voltage division;

a second comparison unit, having a first input terminal and a second input terminal respectively coupled to the control module and the voltage divider unit, for comparing the voltage division with the output of the control module to output a comparison voltage;

a dynamic sawtooth wave generator, coupled to the second comparison unit, for outputting a sawtooth wave signal according to the comparison voltage;

a third comparison unit, having a first input terminal and a second input terminal respectively coupled to a boost voltage and the dynamic sawtooth wave generator, and having an output terminal coupled to the power conversion circuit, for outputting a first pulse width modulation (PWM) signal according to a comparison result of the boost voltage and the sawtooth wave signal; and a fourth comparison unit, having a first input terminal and a second input terminal respectively coupled to a buck voltage and the dynamic sawtooth wave generator, and having an output terminal coupled to the power conversion circuit, for outputting a second PWM signal according to a comparison result of the buck voltage and the sawtooth wave signal, wherein the feedback signal comprises the first PWM signal and the second PWM signal.

5. The current-type driver according to claim 4, wherein the voltage divider unit comprises:

a first resistor; and a second resistor, wherein the second resistor and the first resistor are connected between the output voltage and the ground in series.

6. The current-type driver according to claim 4, wherein the dynamic sawtooth wave generator comprises:

an upper limit voltage generator, coupled to the comparison voltage, for generating an upper limit voltage according to the comparison voltage, wherein the comparison voltage differs from the upper limit voltage for a fixed voltage, and the upper limit voltage is a voltage peak value of the sawtooth wave signal;

a fifth comparison unit, having a first input terminal and a second input terminal respectively coupled to the sawtooth wave signal and the upper limit voltage;

a sixth comparison unit, having a first input terminal and a second input terminal respectively coupled to the comparison voltage and the sawtooth wave signal;

a SR latch, having a SET terminal and a RESET terminal respectively coupled to output terminals of the fifth comparison unit and the sixth comparison unit;

a first current source, coupled to an operating voltage;

a first p-type transistor, coupled between the first current source and an output terminal of the dynamic sawtooth wave generator, having a gate coupled to an output terminal of the SR latch;

a first n-type transistor, coupled between the output terminal of the dynamic sawtooth wave generator and the ground, having a gate coupled to the output terminal of the SR latch; and a capacitor, coupled between the output terminal of the dynamic sawtooth wave generator and the ground.

7. The current-type driver according to claim 6, wherein the dynamic sawtooth wave generator further comprises:

a second current source, coupled between a source of the first n-type transistor and the ground.

8. The current-type driver according to claim 6, wherein the upper limit voltage generator comprises:

a third current source, coupled between the operating voltage and an output terminal of the upper limit voltage generator; and a second p-type transistor, coupled between the output terminal of the upper limit voltage generator and the ground, having a gate coupled to the comparison voltage.

9. The current-type driver according to claim 1, wherein the control module comprises:

a control unit, having a plurality of output terminals, wherein the driving signal and the adjusting signal are output from the output terminals outputs;

a plurality of switches, wherein each of the switches is coupled to one of the output terminals of the control unit, the switch coupled to the driving signal is controlled by the enabling signal, and the switch coupled to the adjusting signal is controlled by a switch signal; and a digital-to-analog converter (DAC), coupled to the switches, for converting the driving signal or the adjusting signal into an analog signal and outputting the analog signal to the feedback module.

10. The current-type driver according to claim 1, wherein the power conversion circuit comprises:

a third p-type transistor;

a second n-type transistor, wherein the second n-type transistor and the third p-type transistor are connected between an input voltage and a ground in series;

a fourth p-type transistor;

a third n-type transistor, wherein the third n-type transistor and the fourth p-type transistor are connected between the output voltage and the ground in series;

an inductor, coupled between a common contact of the third p-type transistor and the second n-type transistor and a common contact of the fourth p-type transistor and the third n-type transistor; and a PWM unit, coupled to a gate of the third p-type transistor, a gate of the fourth p-type transistor, a gate of the second n-type transistor, a gate of the third n-type transistor, and the feedback module, for controlling on/off states of the third p-type transistor, the fourth p-type transistor, the second n-type transistor, and the third n-type transistor according to the feedback signal, so as to adjust the output voltage.

11. The current-type driver according to claim 1, wherein the light emitting devices are light emitting diodes (LEDs).

12. The current-type driver according to claim 1, wherein the power conversion circuit is a DC/DC converter.

13. The current-type driver according to claim 1 further comprising an output capacitor coupled between an output terminal of the power conversion circuit and a ground.

* * * * *